US008056147B1

(12) United States Patent
Patel

(10) Patent No.: US 8,056,147 B1
(45) Date of Patent: Nov. 15, 2011

(54) NECKTIE HAVING FASTENING SYSTEM FOR SECURING NECKTIE TO SHIRT BUTTON

(76) Inventor: Girish K. Patel, Sunset Beach, CA (US)

( * ) Notice: Subject to any disclaimer, the term of this patent is extended or adjusted under 35 U.S.C. 154(b) by 194 days.

(21) Appl. No.: 12/541,964

(22) Filed: Aug. 16, 2009

(51) Int. Cl.
*A41D 25/04* (2006.01)

(52) U.S. Cl. ..... 2/145

(58) Field of Classification Search ..... 2/144, 145, 2/149; 24/54, 55, 66.1, 66.2
See application file for complete search history.

(56) References Cited

U.S. PATENT DOCUMENTS

| | | | | |
|---|---|---|---|---|
| 1,056,609 | A | | 3/1913 | Walton |
| 1,291,090 | A | | 1/1919 | Nuzum |
| 1,647,407 | A | | 11/1927 | Hostetter |
| 1,707,591 | A | | 4/1929 | Young |
| 1,764,705 | A | | 6/1930 | Ward |
| 1,798,432 | A | | 3/1931 | Ratajack |
| 1,897,734 | A | | 2/1933 | Rossner |
| 2,068,454 | A | | 1/1937 | Helske |
| 2,100,870 | A | | 11/1937 | Petrie et al. |
| 2,195,594 | A | | 4/1940 | Kreisler |
| 2,275,682 | A | | 3/1942 | Rantz |
| 2,481,367 | A | | 9/1949 | Thompson |
| 2,541,660 | A | | 2/1951 | Naftali |
| 2,557,635 | A | | 6/1951 | Cregar |
| 2,736,033 | A | | 2/1956 | Brunetti et al. |
| 2,738,513 | A | | 3/1956 | Carty |
| 2,743,452 | A | | 5/1956 | Waterbury |
| 2,746,055 | A | | 5/1956 | Gleason |
| 2,749,553 | A | | 6/1956 | Miller |
| 2,893,086 | A | | 7/1959 | Parker |
| 2,946,106 | A | | 7/1960 | Moran, Jr. |
| 3,151,371 | A | | 10/1964 | Ellestad |
| 3,453,696 | A | | 7/1969 | Mates |
| 3,487,471 | A | | 1/1970 | Hagen |
| 3,494,003 | A | | 2/1970 | Bower, Jr. |
| 3,827,108 | A | | 8/1974 | Jewett |
| 4,554,710 | A | | 11/1985 | Grant |
| 4,827,536 | A | | 5/1989 | Sung |
| 4,827,576 | A | | 5/1989 | Prince, Jr. |
| 4,920,579 | A | | 5/1990 | Swain |
| 4,972,523 | A | * | 11/1990 | Begg ..... 2/145 |
| 5,007,139 | A | | 4/1991 | Ahern |
| 5,095,546 | A | | 3/1992 | Jones |
| 5,109,547 | A | | 5/1992 | Abdallah |
| 5,165,112 | A | | 11/1992 | Dawes |
| 5,235,730 | A | | 8/1993 | Townsend |
| 5,239,707 | A | | 8/1993 | Pileggi |
| 5,315,713 | A | | 5/1994 | Pileggi |
| 5,353,438 | A | | 10/1994 | Voiles |
| 5,715,538 | A | | 2/1998 | Soll |

(Continued)

*Primary Examiner* — Tejash Patel
(74) *Attorney, Agent, or Firm* — Jerry Turner Sewell

(57) ABSTRACT

A necktie has an integrated system to limit movement of the free ends of the necktie when worn. The necktie has a wide end section and a narrow end section. The necktie has a selected width transition from the wide end section to the narrow end section. The overall length of the necktie is selected to allow the necktie to be secured to a person's neck using a selected knot-tying technique such that the wide end of the necktie is positioned at a selected location with respect to the person's waistline and such that the narrow end of the necktie is positioned behind the wide end of the necktie. At least one loop is secured to the back of the wide end of the necktie. The narrow end of the necktie passes through the loop. At least one buttonhole is formed through the narrow end of the necktie.

8 Claims, 3 Drawing Sheets

U.S. PATENT DOCUMENTS

| | | | |
|---|---|---|---|
| 5,813,053 | A | 9/1998 | Pileggi |
| 5,815,836 | A | 10/1998 | Jacobson, II |
| 6,131,200 | A | 10/2000 | McNamara |
| 6,182,292 | B1 | 2/2001 | Knoll |
| 6,205,587 | B1 | 3/2001 | Shiffler |
| 6,216,275 | B1 | 4/2001 | Lee |
| 7,065,794 | B2 | 6/2006 | Anderson |
| 7,530,119 | B1 * | 5/2009 | Jackson-Miller et al. ..... 2/144 |

* cited by examiner

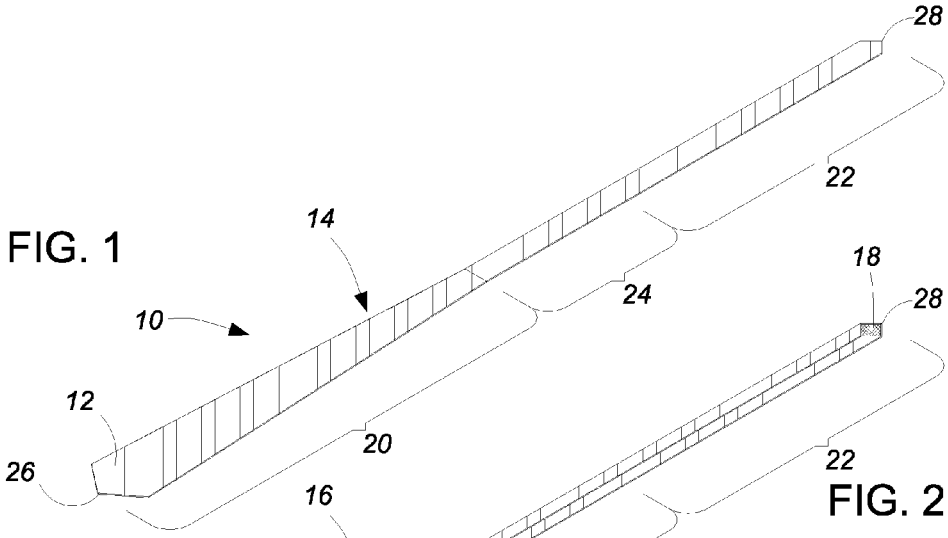
FIG. 1
FIG. 2
FIG. 3
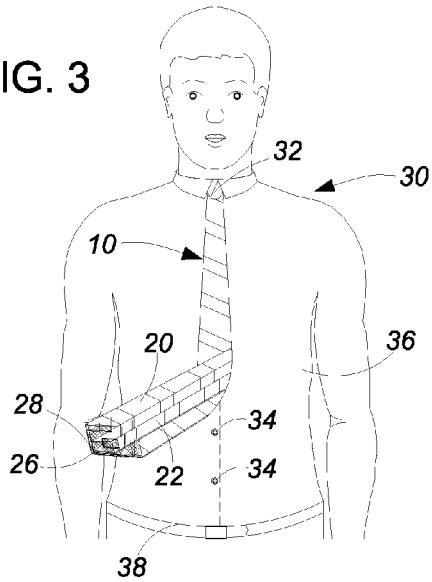
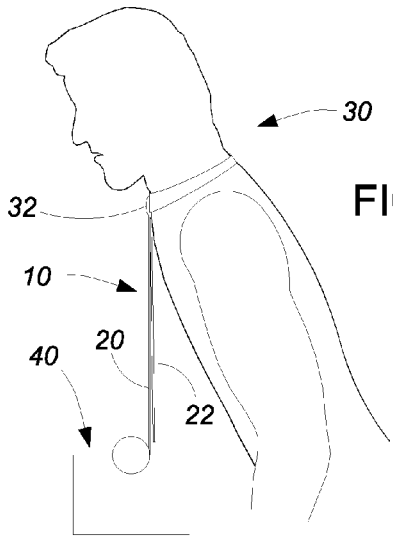
FIG. 4

NECKTIE HAVING FASTENING SYSTEM FOR SECURING NECKTIE TO SHIRT BUTTON

BACKGROUND OF THE INVENTION

1. Field of the Invention

The present invention is in the field of neckties, and, more particularly, is in the field of modifications to neckties to allow the ends of the necktie to be secured.

2. Description of the Related Art

A necktie is a long piece of cloth or other suitable flexible material worn around the neck of a person and having loose ends that extend downwards from a knot at the throat of the person. Although many variations exist regarding the use of a necktie, for business purposes and for formal and semiformal social purposes, a necktie is worn with a dress shirt with the loose ends of the necktie covering the front buttons of the dress shirt.

Neckties are available with many different patterns and are also available in many different sizes and shapes. In general, a conventional necktie has a relatively broad end section and a relatively narrow end section. Usually, but not always, short length of the necktie proximate the each end section is formed into a generally triangular point. The width of a conventional necktie varies gradually between the broad end section and the narrow end section.

The overall length of a necktie may vary. In general, the length of a necktie is selected so that a first middle portion of the necktie passes around a person's neck, a second middle portion of the necktie is formed into a selected knot to secure the necktie at the neck, and a length of the broad end portion and a length of the narrow end portion extends below the knot with the broad end portion being positioned over the narrow end portion. Preferably, if the knot is formed properly and the length of the necktie is selected in accordance with the neck size and the torso length of the person wearing the necktie, the end of broad end portion will be positioned within a selected distance of the waistline (beltline) of the wearer, and the narrow end portion will be hidden from view behind the broad end portion.

The bane of a necktie wearer is the usual uncontrollability of the broad end portion of the necktie. The broad end portion may move because of wind and other air movement such that the broad end portion flops over the wearer's shoulder thus defeating the aesthetic purpose for wearing the necktie. When the wearer leans forward in a buffet line, the broad end portion may touch food or liquid that may mar the appearance of the necktie. The broad end portion may also be caught in moving parts of equipment, which can mar the appearance of the necktie, and, in some cases, may also cause harm to the wearer.

Many systems have been developed to secure the loose ends of a necktie. For example, a tie clip may be used to secure a necktie to the wearer's shirt. A tie clip may detract from the aesthetic appearance of the necktie, and over time may cause form a permanent wrinkle in the necktie. A tie tack may also be used, but a tie tack may also detract from the aesthetic appearance of the necktie. Also, a tie tack penetrates the material of a necktie and thus may permanently mar the appearance of the necktie. Other systems have modified the necktie to allow the necktie to be secured to buttons. Prior systems do not provide the convenience and aesthetic advantages of the system disclosed and claimed herein.

SUMMARY OF THE INVENTION

A necktie has an integrated system to limit movement of the free ends of the necktie when worn. The necktie comprises a selected material formed into the shape of a necktie having a wide end section and a narrow end section. The necktie has a selected width transition from the wide end section to the narrow end section. The necktie has an overall length selected to allow the necktie to be secured to a person's neck using a selected knot-tying technique such that the wide end of the necktie is positioned at a selected location with respect to the person's waistline and such that the narrow end of the necktie is positioned behind the wide end of the necktie. At least one loop is secured to the back of the wide end of the necktie. The loop is sufficiently large to allow the narrow end of the necktie to pass through the loop. At least one buttonhole is formed through the narrow end of the necktie. Preferably, the buttonhole is sized to correspond to the shape of a buttonhole on a shirt. In particularly preferred embodiments, the necktie includes a plurality of buttonholes, with at least two buttonholes spaced apart by a distance selected to position at least one buttonhole within a selected distance from a button on a shirt. In one embodiment, at least two buttonholes are spaced apart by a distance selected to correspond to the spacing between adjacent buttonholes on a shirt. In another embodiment, the necktie includes at least a first buttonhole, a second buttonhole and a third buttonhole, wherein the first buttonhole and the second buttonhole are spaced apart by a first distance less than the spacing between adjacent buttonholes on a shirt, wherein the second buttonhole and the third buttonhole are spaced apart by a second distance less than the spacing between adjacent buttonholes on a shirt. Preferably, the first distance and the second distance are substantially equal.

An embodiment in accordance with an aspect of the present invention is a method for securing a necktie to the shirt of a person wearing the necktie to reduce the range of movement of a broad, first free end and a narrow, second free end of the necktie. The method includes the act of securing a middle portion of the necktie around the neck of the person using a selected one of a conventional knot. The lengths of the first and second free ends of the necktie are adjusted to obtain a desired relationship between the free ends of the necktie with a front surface of the broad, first free end exposed to view and with the narrow, second free end of the necktie positioned between the broad, first end and the shirt of the person. The narrow, second free end of the necktie is passed through a loop on a rear surface of the broad, first free end of the necktie, with a tail portion of the narrow, second free end of the necktie extending below the loop. The tail portion has at least one buttonhole extending through the tail portion. The method further includes securing the at least one buttonhole to a button on the person's shirt to secure the tail portion to the person's shirt. The interaction of the loop with the tail portion limits the movement of the broad, first free end away from the person's shirt. Preferably, the at least one buttonhole comprises a plurality of buttonholes on the tail portion of the necktie, and the act of securing the at least one buttonhole to the button on the person's shirt comprises selecting one of the plurality of the buttonholes that is closest to being aligned with a button on the person's shirt.

BRIEF DESCRIPTION OF THE DRAWINGS

Embodiments in accordance with aspects of the present invention are described below in connection with the attached drawings in which:

FIG. 1 illustrates a perspective view of the front side of an exemplary conventional necktie;

FIG. 2 illustrates a perspective view of the back side of the conventional necktie of FIG. 1;

FIG. 3 illustrates a front elevational view of the conventional necktie of FIGS. 1 and 2 positioned around a person's neck and secured by a knot formed in the necktie proximate the person's throat with the lower portion of the necktie folded back to show the buttons on the shirt worn by the person;

FIG. 4 illustrates a side elevational view of the conventional necktie of FIG. 3 when the person leans over an object thus allowing the free ends of the necktie to move away from the person's torso;

DETAILED DESCRIPTION OF PREFERRED EMBODIMENTS

Figure 5:
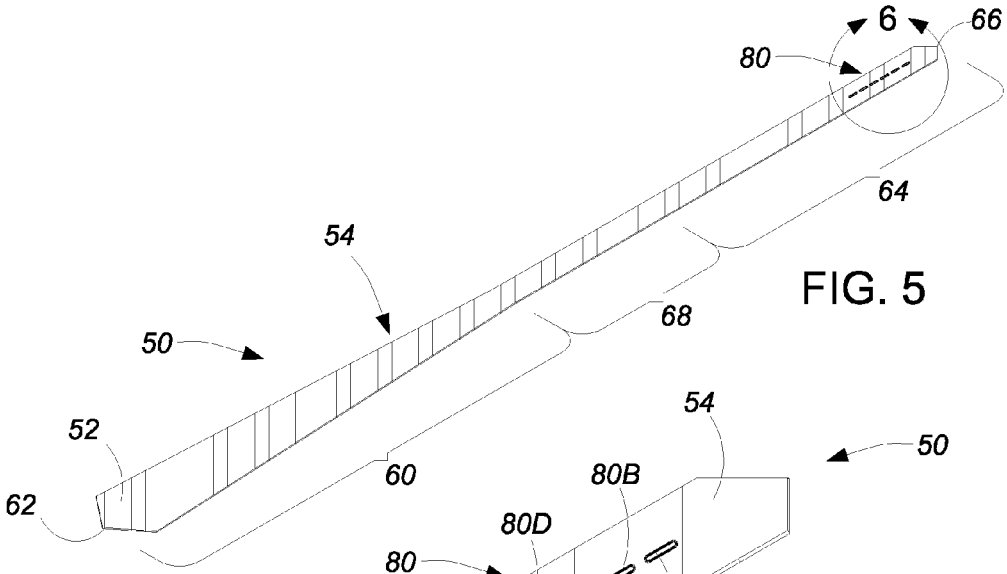
FIG. 5 illustrates a perspective view of the front side of an embodiment of an improved necktie in accordance with aspects of the present invention showing a plurality of buttonholes formed through the tail (narrow portion) of the necktie.

The fastening system is disclosed herein with respect to exemplary embodiments. The embodiments are disclosed for illustration of the fastening system and are not limiting except as defined in the appended claims.

FIGS. 1 and 2 illustrate an embodiment of a conventional necktie 10 into which the fastening system may be incorporated. The necktie 10 comprises cloth 12 or other suitable flexible material. The cloth 12 is cut into a suitable size and shape and then a portion of the cloth 12 is folded into the shape of a front side 14 of the necktie 10 by folding portions of the cloth to a back side 16 of the necktie as shown in FIG. 2. The edges of the cloth 12 generally overlap in the back and are sewn together to retain the shape of the necktie 10. In the illustrated necktie 10, a cloth liner 18 is secured to the back of the cloth 12 before folding to provide additional body for the necktie 10. The cloth liner 18 may advantageously comprise silk or other material. In certain embodiments, the cloth liner may comprise a heavier cloth such as wool to aid in maintaining the shape of the necktie 10.

As shown in FIG. 1, the front side 14 of the necktie 10 is generally smooth and continuous. The front side 14 advantageously includes a pattern or a solid color in accordance with a desired aesthetic appearance. The front side 14 may also have a desired texture. For example, many neckties are formed from silk or other fine cloth material. The back side 16 of the necktie 10 is generally not configured to be aesthetically pleasing. Accordingly, the liner 18 and the overlapping edges of the cloth 12 may be seen on the back side 16 as shown in FIG. 2.

The necktie 10 has a first end portion 20 (referred to commercially as the front or bid), a second end portion (referred to commercially as the back or spine) 22 and a body portion (referred to commercially as the neckpiece) 24. The first end portion 20 is terminated at a first terminal end 26, and the second end portion is terminated at a second terminal end 28. In the illustrated embodiment, the two terminal ends 26, 28 are broadly pointed as shown; however, the terminal ends may also be generally straight in alternative embodiments.

Although the cloth 12 of the necktie 10 is illustrated as one continuous length of cloth in FIGS. 1 and 2, one skilled in the art will appreciate that the cloth 12 may comprise three sections of cloth that are sewn together to form the necktie 10 shown in FIGS. 1 and 2.

Generally, the first end portion 20 is substantially wider than the second end portion 22 and the body portion 24. For example, the first end portion 20 may advantageously have a maximum width of approximately 4 inches proximate to a first terminal end 26. The second end portion 22 and the body portion 24 may advantageously have a common width of approximately 1.5 inches. In the illustrated embodiment, the width of the first end portion 20 gradually narrows toward the body portion 24 to form the tapered appearance shown in FIGS. 1 and 2. For example, in the illustrated embodiment, the width of the necktie 10 generally tapers from the width of the broader first end portion 20 to the width of the narrower second end portion 22 and the body portion 24 over a distance that is about one-half the overall length of the necktie 10 such that approximately one-half of the overall length of the necktie 10 has the width of the narrower second end portion 22. Other tie configurations with different combinations of widths, tapers and relative lengths of the portions of the necktie are known.

As illustrated in FIG. 3, the overall length of the necktie 10 from the terminal end 26 of the first end portion 20 to the terminal end 28 of the second end portion 22 is selected so that the necktie 10 has a sufficient length to allow the necktie 10 to be wrapped around the neck of a person 30 and secured by a knot 32 with sufficient portions of the first end portion 20 and the second end portion 22 extending below the knot 32 in front of the buttons 34 of the person's shirt 36 as shown in FIG. 3. The first end portion 20 and the second end portion 22 of the necktie 10 are folded back in FIG. 3 to show the underlying buttons 34. The overall length of the necktie 10 is selected in accordance with the size of the person's neck, the length of the person's torso, the desired position of the terminal end 26 of the first end portion 20 with respect to the person's waistline (beltline) 38, and the type of knot 32 to be formed with the necktie 10 (e.g., full Windsor, half Windsor, four-in-hand, or the like).

The foregoing description of the conventional necktie 10 is provided for illustration only and is not intended to limit the fastening system described below to any particular size or shape of necktie. Furthermore, the necktie 10 may include other layers of cloth and liners to achieve a desired aesthetic or functional characteristic.

As illustrated in FIG. 4, one of many disadvantages of the conventional necktie 10 occurs when the person 30 leans over while wearing the necktie 10. For example, the free first end portion 20 may move away from the torso of the person 30 and move into contact with an object 40. Such contact may be benign in many cases; however, if the object 40 represents food in a serving line or water or other materials on a table or desk, the first end portion 20 may become marred by food or liquid stains. Since many neckties comprise silk or other expensive cloth material, the necktie 10 may be effectively destroyed by the contact. If the object 40 represents an operating machine with moving parts, the first end portion 20 may be drawn into the machine and damaged. In some cases, the person 30 wearing the necktie 10 may be harmed by the interaction of the necktie 10 with the machine.

As discussed above, many ideas have been presented for preventing the movement of neckties away from the wearer's body. None of the previous ideas are considered to be satisfactory by the applicant herein.

Figure 6:
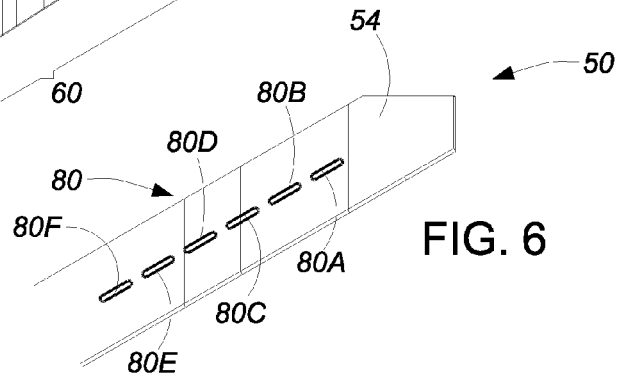
FIG. 6 illustrates a perspective view of the back side of the improved necktie of FIG. 5 showing the buttonholes formed through the tail of the necktie and the loop positioned on back side of the broad portion of the necktie.
Figure 7:
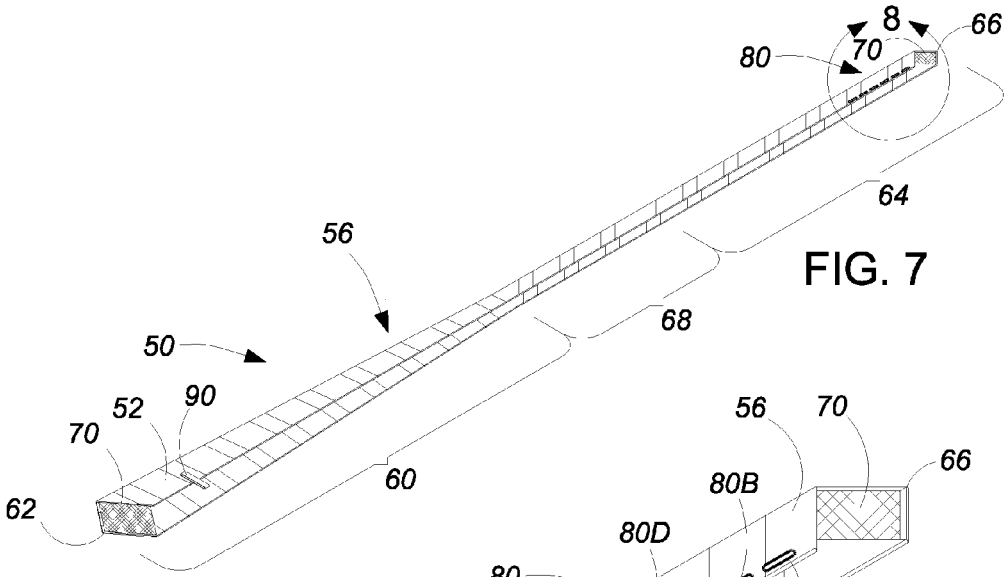
FIG. 7 illustrates an enlarged perspective view of the front side of the tail of the improved necktie of FIG. 5 in the area defined by the circle 7 in FIG. 5.

FIGS. 5-11 illustrate an embodiment of a necktie 50 in accordance with aspects of the present invention. The necktie 50 comprises cloth 52 or other suitable flexible material as discussed above for the conventional necktie 10. FIGS. 5 and 6 illustrate the front side 54 and the back side 56, respectively, of the necktie 50. The necktie 50 includes a broad first end portion 60 having a first terminal end 62, a narrow second end portion 64 having a second terminal end 66 and an intermediate body portion 68. The terminal ends 62 and 66 are advantageously pointed as shown but may have other configurations. The necktie 50 advantageously includes a liner 70 as described above for the conventional necktie 10.

Unlike the previously described conventional necktie 10, the necktie 50 includes at least one buttonhole 80 formed in the narrow second end portion 64 proximate to the second terminal end 66. For example, as shown in the enlarged views in FIGS. 7 and 8, the at least one buttonhole 80 comprises six buttonholes 80A, 80B, 80C, 80D, 80E, 80F.

Each of the buttonholes 80A-F is formed in a conventional manner by adding tightly spaced stitches substantially at the midpoint of the narrow end portion 64 in the form of a respective buttonhole pattern (e.g., a relatively long and relatively narrow oval shape with the stitches on the parallel long sides of the oval shape almost touching). Preferably, each of the buttonholes 80A-F is formed using an automatic buttonhole attachment available on commercially available sewing machines. The size of each buttonhole 80A-F is selected to correspond to the size of a buttonhole on the front of a typical dress shirt.

Each buttonhole 80A-F is formed through the entire thickness of the narrow end portion 64 so that the stitches of each buttonhole secure the portion of the cloth 52 on the front side 54 to the overlapping portions of the cloth 52 on the back side 56. The stitches also pass through the liner 70 if included as part of the necktie 50.

After the buttonhole stitches are formed, the layers of the cloth 52 and the liner 70 are carefully cut from the front side 54 to the back side 56 of the second end portion 64 within the oval of each of the buttonholes 80A-F without cutting any of the stitches. Thus, each of the buttonholes 80A-F comprises reinforcing stitching surrounding an opening that passes from the front side 54 to the back side 56 of the necktie 50 in the second end portion 64.

As further shown in FIG. 6, the back side 56 of the necktie 50 includes a loop 90 that is positioned on the broader first end portion 60. The loop 90 is positioned on the broader first end portion 60 at a distance from the first terminal end 62 such that when the necktie 50 is secured on a person 100 with second terminal end 66 generally aligned with the first terminal end 62, as shown in FIG. 9, the five buttonholes 80A-F are positioned between the first terminal end 62 and the loop 90.

Figure 8:
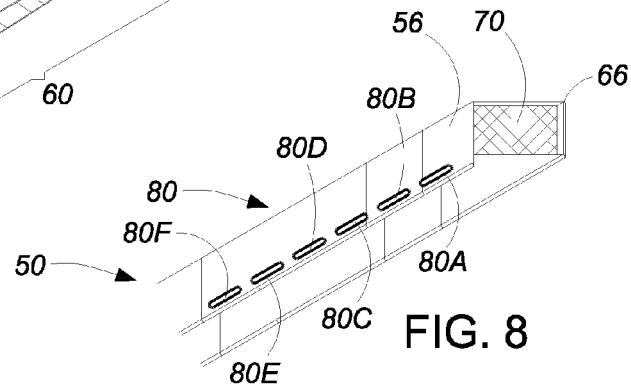
FIG. 8 illustrates an enlarged perspective view of the back side of the improved necktie of Figure in the area defined by the circle 8 in FIG. 6.
Figure 9:
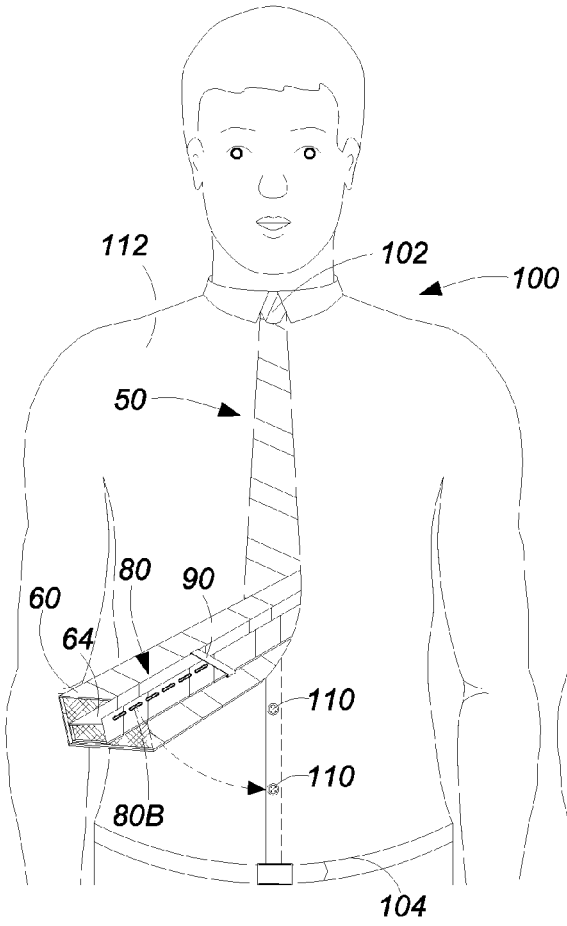
FIG. 9 illustrates a front elevational view of the improved necktie of FIGS. 5-8 positioned around a person's neck and secured by a knot formed in the necktie proximate the person's throat with the lower portion of the necktie folded back to show the buttons on the shirt worn by the person.
Figure 10:
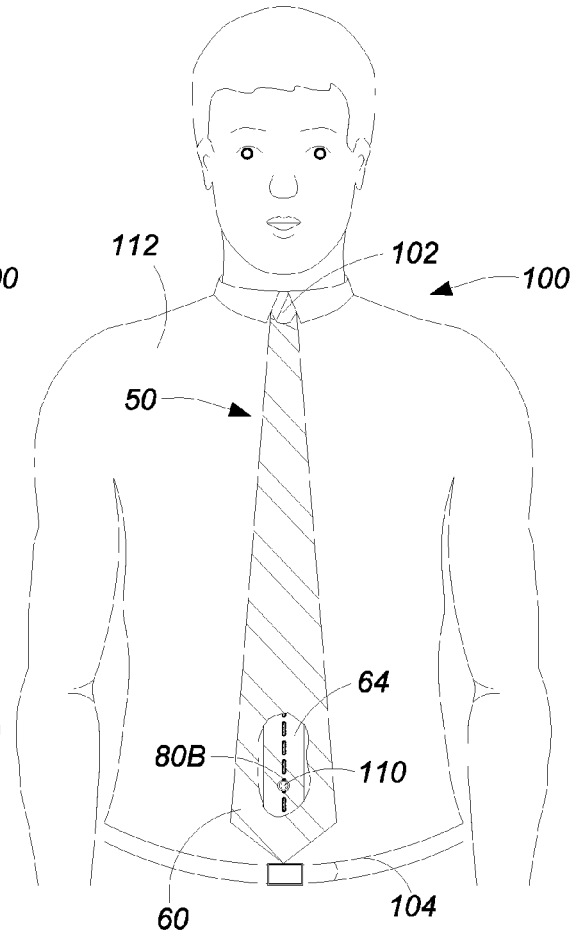
FIG. 10 illustrates the front elevational view of the improved necktie positioned around the person's neck as shown in FIG. 9 but with the necktie unfolded and secured by the engagement of a buttonhole with a button on the person's shirt as shown in the partially cutaway view.
Figure 11:
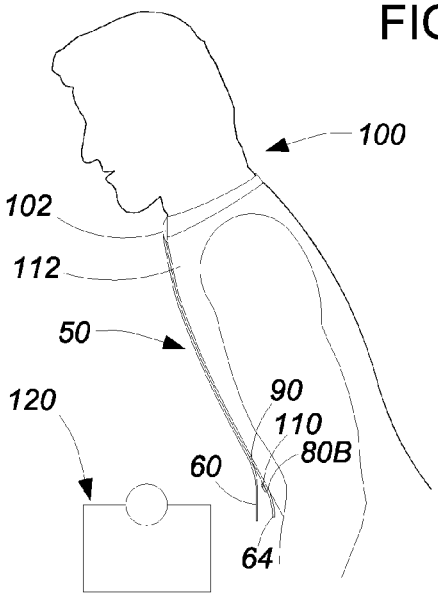
FIG. 11 illustrates the improved necktie of FIGS. 5-10 when the person leans over an object, wherein the free ends of the necktie are maintained close to the person's torso by the engagement of a buttonhole of the necktie with the button on the person's shirt as shown in FIG. 10.

FIGS. 9-11 illustrate the necktie 50 of FIGS. 5-8 when worn by the person 100 with a portion of the necktie 50 forming a knot 102 at the person's neck and with the first end portion 60 and the second end portion 64 extending downward from the knot 102 proximate to the person's waistline (beltline) 104. The second terminal end 66 of the second end portion 64 passes through the loop 90 so that at least one of the buttonholes 80A-F is positioned below the loop 90. Preferably, the position of the terminal end 66 of the second end portion 64 is adjusted so that at least one of the buttonholes 80A-F (e.g., the buttonhole 80B in the illustrated example) is aligned with a button 110 of a shirt 112 worn by the person 100. The button 110 is positioned through the selected buttonhole 80B to secure the second end portion 64 to the person's shirt 112.

When the second end portion 64 is secured to the person's shirt 112 as shown in FIG. 8, the loop 90 effectively secures the first end portion 60 close to the first terminal end 62 to limit the movement of the first end portion 60 away from the shirt 112. Thus, as illustrated in FIG. 11, when the person 100 leans over an object 120, all but a short portion of the end portion 60 of the necktie 50 remains close to the torso of the person 100 so that the end portion 60 of the necktie 50 is substantially less likely to move into contact with the object 120.

In the embodiment illustrated in FIGS. 5-9, the buttonholes 80A-F are spaced apart by a distance selected to be less than the distance between adjacent buttons on a standard dress shirt (e.g., approximately 3.5 inches). For example, in one embodiment, the buttonholes 80A-F are spaced apart by a distance of approximately 0.7 inch so that the six buttonholes 80A-F span the distance between adjacent buttons on a standard dress shirt. In alternative embodiments, the distance between each pair of adjacent buttonholes 80 may be selected to be different from each other.

The additional buttonholes provide smaller increments of distance between the buttonholes and may allow more than one buttonhole to be secured to a button 110 on the person's shirt 112 depending on the adjustment of the positions of the first terminal end 62 and the second terminal end 66 of the tie 50. For example, in the six-buttonhole embodiment having the preferred spacing, when the lowermost buttonhole 80A is aligned with a button 110 on the standard dress shirt, the uppermost buttonhole 80F is also aligned with another button 110 so that the buttonhole 80A and the buttonhole 80F may both be engaged with respective buttons 110 on the shirt 112 for additional security. Depending on factors such as the overall length of the tie 50, the size of a wearer's neck and the type of knot formed in the tie, the lengths of the end portions 60, 64 may be adjusted such that both the buttonhole 80A and the buttonhole 80F pass through the loop 90 and engage buttons 110 below the loop 90. The lengths of the end portions 60, 64 may also be adjusted such that the buttonhole 80A passes through the loop 90 while other buttonholes, including the buttonhole 80F, remain above the loop 90.

As shown in FIGS. 5-11, the security provided by the improved fastening system is provided without marring the appearance of the necktie 50. In particular, when viewed from the front of the necktie 50, no indication is provided that the necktie 50 is secured in any manner. Thus, the security system can be included with any necktie without interfering with the aesthetic appearance of the necktie.

As various changes could be made in the above constructions without departing from the scope of the invention, it is intended that all the matter contained in the above description or shown in the accompanying drawings shall be interpreted as illustrative and not in a limiting sense.

What is claimed is:

1. A necktie having an integrated system to limit movement of the free ends of the necktie when worn, the necktie consisting of:

a selected material formed into the shape of a necktie having a wide end section terminated in a first end of the necktie and a narrow end section terminated in a second end of the necktie, the necktie having a selected width transition from the wide end section to the narrow end section, the necktie having an overall length from the first end of the necktie to the second end of the necktie selected to allow the necktie to be secured to a person's neck using a selected knot-tying technique such that the first end of the necktie is positioned at a selected location with respect to the person's waistline and such that the second end of the necktie is positioned behind the wide end of the necktie proximate to the first end of the necktie;

a plurality of buttonholes formed through an engagement portion of the narrow end section of the necktie, the engagement portion extending for a selected distance from the second end of the necktie, each of the plurality of buttonholes sized to receive a button of a shirt, each buttonhole providing an opening from a rear surface of the engagement portion to the front surface of the engagement portion; and at least one loop secured to the back of the wide end section of the necktie, the loop being sufficiently large to allow the narrow end section of the necktie to pass through the loop, the loop being displaced from the first end of the necktie by a distance selected to position the at least one of the plurality of buttonholes between the loop and the first end of the necktie when the second end of the necktie is positioned proximate to the first end of the necktie, the loop being positioned sufficiently close to the first end of the necktie such that no more than the engagement portion of the narrow end section is positioned between the loop and the first end of the necktie when the narrow end section of the necktie is passed through the loop and the second end of the necktie is positioned behind the first end of the necktie.

2. The necktie as defined in claim 1, wherein each of the plurality of buttonholes is sized to correspond generally to the shape of a buttonhole on the shirt.

3. The necktie as defined in claim 1, wherein the plurality of buttonholes comprises at least two buttonholes spaced apart by a distance selected to position at least one buttonhole within a selected distance from a button on the shirt when the second end of the necktie is positioned behind the wide end of the necktie proximate to the first end of the necktie.

4. The necktie as defined in claim 1, wherein:

the plurality of buttonholes formed through the narrow end section of the necktie comprises at least a first buttonhole, a second buttonhole and a third buttonhole;

the first buttonhole and the second buttonhole are spaced apart by a first distance less than the spacing between adjacent buttons on the shirt; and the second buttonhole and the third buttonhole are spaced apart by a second distance less than the spacing between adjacent buttons on the shirt.

5. The necktie as defined in claim 4, wherein the first distance and the second distance are substantially equal.

6. The necktie as defined in claim 1, wherein:

the plurality of buttonholes comprises at least a first buttonhole and a second buttonhole; and the first buttonhole and the second buttonhole are spaced apart by a distance approximately equal to the spacing between adjacent buttons on the shirt.

7. A method for securing a necktie to the shirt of a person wearing the necktie to reduce the range of movement of a broad, first portion of the necktie proximate to a first free end of the necktie and to restrict the movement of a narrow, second portion of the necktie proximate to a second free end of the necktie, consisting of:

securing a middle portion of the necktie around the neck of the person using a selected conventional knot;

adjusting the lengths of the first and second portions of the necktie with respect to the knot to establish a desired relationship between the position of the first free end of the necktie and the position of the second free end of the necktie and to locate the first free end of the necktie at a desired position with respect to the person's waistline, the second portion of the necktie being positioned between the first portion of the necktie and the shirt of the person;

passing the second free end of the necktie through a loop on a rear surface of the first portion of the necktie, with a tail portion of the second portion of the necktie extending below the loop, the tail portion having a plurality of buttonholes extending through an engagement portion of the tail portion such that the at least one buttonhole is located between the loop and the first free end of the necktie when the tail portion is extending below the loop, the loop being positioned at a location on the rear surface of the first portion of the necktie, the location of the loop selected such that no more than the engagement portion of the tail portion is positioned between the loop and the first free end of the necktie; and securing the at least one buttonhole to a button on the person's shirt by inserting a button through the buttonhole from a rear surface of the engagement portion, the button then resting on the front surface of the engagement portion to secure the tail portion to the person's shirt, the interaction of the loop with the tail portion thereby limiting the movement of the first portion of the necktie away from the person's shirt.

8. The method for securing a necktie as defined in claim 7, wherein the at least one buttonhole comprises a plurality of buttonholes on the tail portion of the necktie, and wherein the act of securing the at least one buttonhole to the button on the person's shirt comprises selecting one of the plurality of the buttonholes that is closest to being aligned with a button on the person's shirt.

* * * * *